US007140932B2

(12) United States Patent
Mizuguchi et al.

(10) Patent No.: US 7,140,932 B2
(45) Date of Patent: Nov. 28, 2006

(54) OUTBOARD MOTOR SHIFT MECHANISM

(75) Inventors: Hiroshi Mizuguchi, Wako (JP); Hideaki Takada, Wako (JP); Yoshinori Masubuchi, Wako (JP); Koji Kasai, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/757,389

(22) Filed: Jan. 15, 2004

(65) Prior Publication Data

US 2004/0229524 A1 Nov. 18, 2004

(30) Foreign Application Priority Data

Jan. 17, 2003 (JP) ..... 2003-010048
Feb. 14, 2003 (JP) ..... 2003-036740
Feb. 14, 2003 (JP) ..... 2003-036741
Feb. 14, 2003 (JP) ..... 2003-036742

(51) Int. Cl.
*B63H 20/20* (2006.01)

(52) U.S. Cl. ..... 440/75; 192/21; 192/51

(58) Field of Classification Search ..... 440/75, 440/83, 86; 192/21, 51
See application file for complete search history.

(56) References Cited

U.S. PATENT DOCUMENTS 4,747,796 A * 5/1988 Iwai et al. ..... 440/83
5,147,231 A * 9/1992 Kawai et al. ..... 440/75
5,230,643 A * 7/1993 Kanno ..... 440/86
6,062,360 A * 5/2000 Shields ..... 192/21
6,217,400 B1 * 4/2001 Natsume ..... 440/75
6,544,083 B1 * 4/2003 Sawyer et al. ..... 440/75
6,547,613 B1 * 4/2003 Onoue et al. ..... 440/83
6,609,939 B1 * 8/2003 Towner et al. ..... 440/111
2003/0224672 A1 * 12/2003 Takada et al. ..... 440/75

FOREIGN PATENT DOCUMENTS

| | | |
|---|---|---|
| JP | 41-16804 | 8/1966 |
| JP | 59-073627 | 4/1984 |
| JP | 04-095598 | 3/1992 |
| JP | 06-329091 A | 11/1994 |
| JP | 09-123996 A | 5/1997 |
| JP | 11-334694 A | 12/1999 |
| JP | 2000-280983 | 10/2000 |
| JP | 2001-260986 A | 9/2001 |

* cited by examiner

*Primary Examiner*—Andrew D. Wright
(74) *Attorney, Agent, or Firm*—Westerman, Hattori, Daniels & Adrian, LLP.

(57) ABSTRACT

In a shift mechanism for an outboard motor mounted on a stem of a boat and having an internal combustion engine at its upper portion and a propeller at its lower portion that is powered by the engine to propel the boat, having an electric motor installed in the outboard motor, a shift rod rotatably connected to the electric motor, a shifter clutch connected to the shift rod, the shifter clutch being movable by the shift rod from a neutral position to engage with at least one of a forward gear and a reverse gear, and a controller controlling the electric motor to rotate the shift rod such that the shifter clutch engages with the forward gear or the reverse gear, corresponding to an inputted shift instruction made by the operator, there is provided a shock mitigator mitigating shock generated during the shift. The shock mitigator comprises projections formed on the clutch and the forward/reverse gear. Alternatively, the electric motor and its reduction-gear mechanism are accommodated in a case to be located above the shift rod. Further, there is provided an emergency gear that allows the shift rod to be rotated manually to effect shift.

6 Claims, 16 Drawing Sheets

OUTBOARD MOTOR SHIFT MECHANISM

BACKGROUND OF THE INVENTION

1. Field of the Invention

This invention relates to a shift mechanism for an outboard motor.

2. Description of the Related Art

In outboard motor shift mechanisms, a shift is usually changed by moving a shift rod having a cam at its distal end in the longitudinal direction to slide a shift slider such that a clutch is switched from its neutral position to a forward position where it engages with a forward gear or a reverse position where it engages with a reverse gear.

Alternatively, a shift rod is provided with a rod pin at a position eccentric from the rod center, in such a way that a shift slider is slid to effect shift by a distance due to a displacement of the rod pin caused by a rotation of the shift rod. The distance of travel of the rod pin corresponds to a circular arc whose radius is the amount of eccentricity of the rod pin.

In the outboard motor shift mechanisms including that mentioned above, when the shift rod is operated manually, since the operator tends to have an unpleasant operation "feel" owing to, for instance, heavy load, it has hitherto been proposed installing an actuator at the hull and connecting it with the shift rod in the outboard motor through a cable or a link mechanism to power-assist the driving of the shift rod, i.e. the shift, as taught in Japanese Laid-Open Patent Application No. Hei 4 (1992)-95598.

The add-on system using such an actuator has disadvantages that its structure is complicated, that it adds to the number and weight of the components, and it needs a space for the actuator at the hull.

Further, the outboard motor shift mechanisms are usually constituted as a meshed type of clutch comprising a shifter clutch and forward/reverse gears to be meshed therewith, i.e., the so-called "dog clutch". In this type of clutch, unless the rotation of drive shaft side (forward/reverse gears) and that of driven shaft side (shifter clutch) are in synchronism with each other, projections formed thereon do not fit into mated recesses smoothly at the beginning of shift, thereby causing shock to happen. With this, the drive train (including the drive shaft, propeller shaft) may have excessive stress.

In order to avoid this problem, it has been known to mitigate such an excessive stress by dividing the drive shaft and propeller shaft into two parts and by connecting them through an elastic member, as disclosed in Japanese Laid-Open Patent Application No. 2000-280983. However, this also has disadvantages that its structure is complicated, that it adds to the number and weight of the components.

Furthermore, when an actuator is installed to move the shift rod, the shift rod may preferably be moved without using the actuator, in case of failure of the actuator.

SUMMARY OF THE INVENTION

An object of the present invention is therefore to overcome the foregoing issues by providing a shift mechanism for an outboard motor that improves operation feel, is simply configured to avoid increase in number of components and weight, while avoiding a problem regarding space utilization.

Another object of the present invention is to provide a shift mechanism for an outboard motor that is simply configured to avoid increase in number of components and weight, while mitigating shock or stress during shift.

Still another object of the present invention is to provide a shift mechanism for an outboard motor that is simply configured to avoid increase in number of components and weight, while enabling to move the shift rod without using the actuator in case of failure of the actuator.

In order to achieve the first and second objects, this invention provides, in its first aspect, a shift mechanism for an outboard motor mounted on a stem of a boat and having an internal combustion engine at its upper portion and a propeller at its lower portion that is powered by the engine to propel the boat, comprising: an actuator installed in the outboard motor; a shift rod installed in the outboard motor and connected to the actuator to be rotatable by the actuator; a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to be propelled in a reverse direction opposite to the forward direction; a controller controlling the actuator to rotate the shift rod such that the shifter clutch moves from the neutral position to engage with one of the forward gear and the reverse gear, corresponding to an inputted shift instruction made by the operator, to effect shift; and a shock mitigator mitigating shock generated during the shift.

In order to achieve the first and second objects, this invention provides, in its second aspect, a shift mechanism for an outboard motor mounted on a stem of a boat and having an internal combustion engine at its upper portion and a propeller at its lower portion that is powered by the engine to propel the boat, comprising: an electric motor installed in the outboard motor; a reduction-gear mechanism connected to the electric motor to reduce a rotation of the electric motor; a shift rod installed in the outboard motor and connected to the reduction-gear mechanism to be rotatable by a reduced rotation of the reduction-gear mechanism; a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to be propelled in a reverse direction opposite to the forward direction; and a case accommodating the electric motor and the reduction-gear mechanism as a unit at a position immediately above the shift rod.

In order to achieve the third object, this invention provides, in its third aspect, a shift mechanism for an outboard motor mounted on a stern of a boat and having an internal combustion engine at its upper portion and a propeller at its lower portion that is powered by the engine to propel the boat, comprising: an actuator installed in the outboard motor; a reduction-gear mechanism connected to the actuator to reduce a rotation of the actuator; a shift rod installed in the outboard motor and connected to the reduction-gear mechanism to be rotatable by a reduced rotation of the reduction-gear mechanism; a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to be propelled in a reverse direction opposite to the forward direction; and an emergency gear manually connectable to the reduction-gear mechanism to rotate the shift rod to effect shift.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor shift mechanism according to a first embodiment of the invention will now be explained with reference to the attached drawings.

Figure 1:
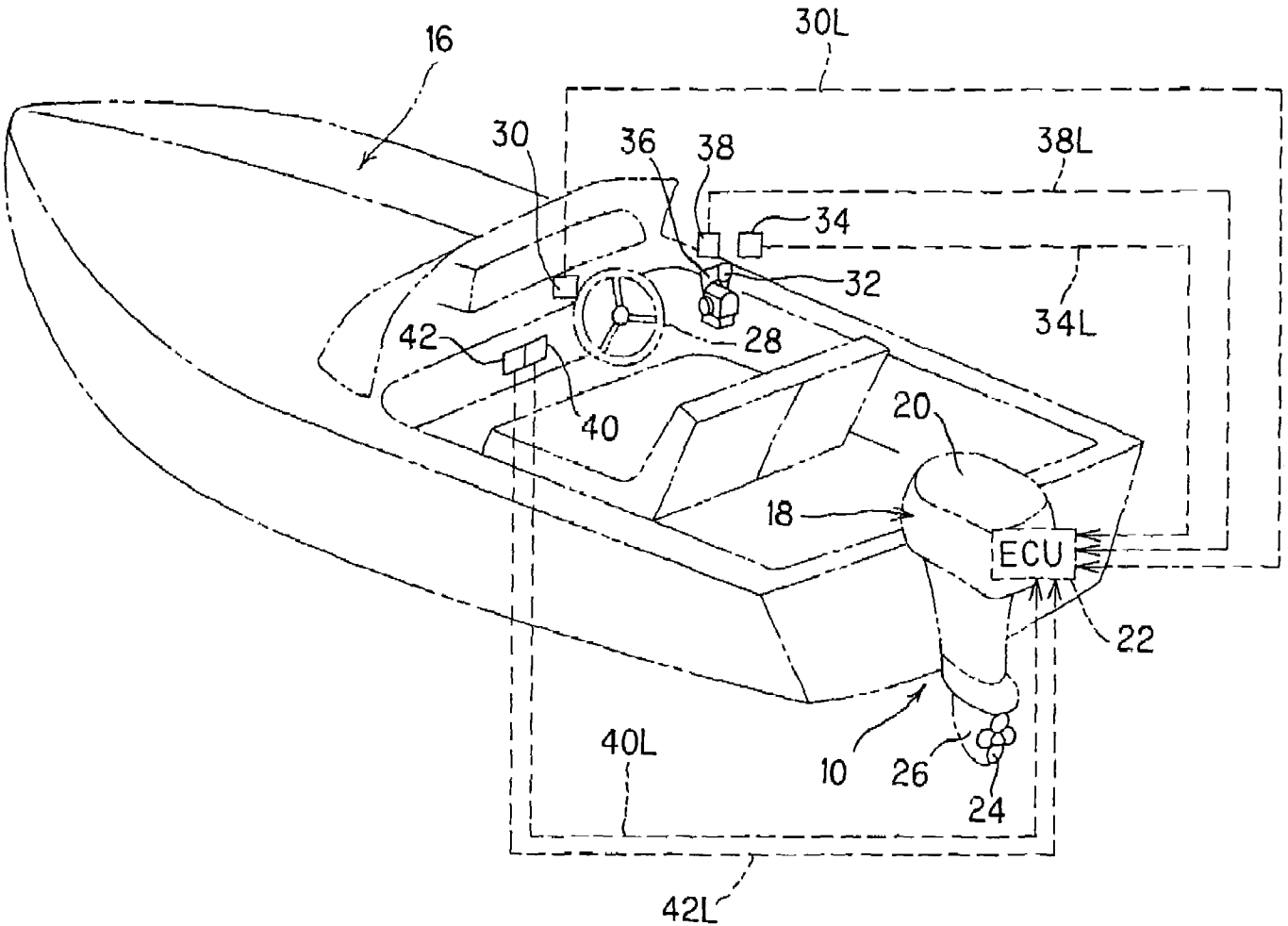
FIG. 1 is an overall schematic view of a shift mechanism for an outboard motor according to an embodiment of the invention.
Figure 2:
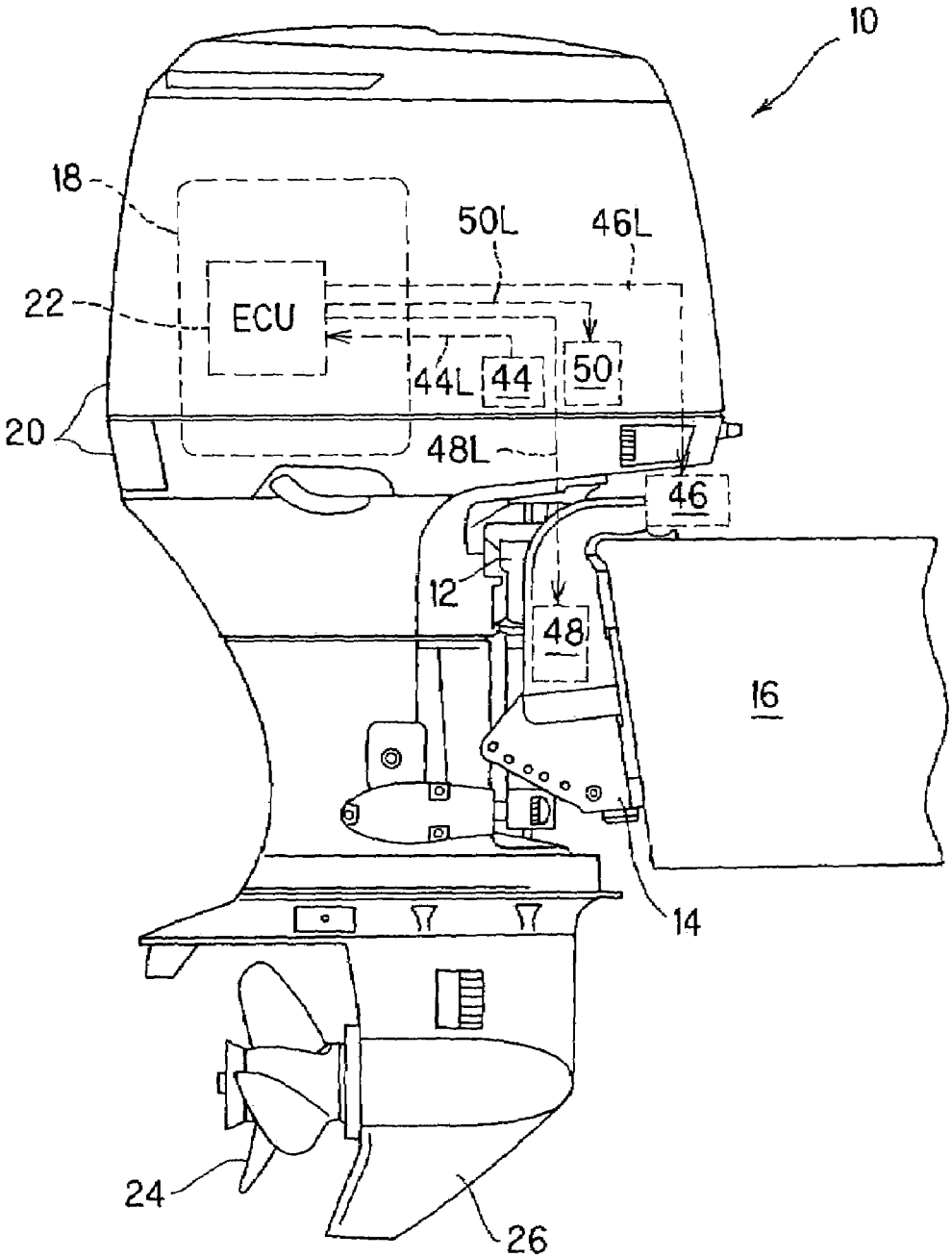
FIG. 2 is an explanatory side view of a part of FIG. 1.

FIG. 1 is an overall schematic view of the shift mechanism for an outboard motor, and FIG. 2 is an explanatory side view of a part of FIG. 1.

Reference numeral 10 in FIGS. 1 and 2 designates an outboard motor built integrally of an internal combustion engine, propeller shaft, propeller and other components. As illustrated in FIG. 2, the outboard motor 10 is mounted on the stem of a boat (hull) 16 via a swivel case 12 (that rotatably accommodates or houses a swivel shaft (not shown)) and stem bracket 14 (to which the swivel case 12 is connected), to be rotatable about the vertical and horizontal axes.

The outboard motor 10 is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU) 22 constituted of a microcomputer is installed near the engine 18 enclosed by the engine cover 20.

The outboard motor 10 is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel (steering device) 28 is installed near the operator's seat of the boat 16. A steering angle sensor 30 is installed near the steering wheel 28. The steering angle sensor 30 is made of a rotary encoder and outputs a signal in response to the turning of the steering wheel 28 inputted by the operator. A throttle lever 32 is mounted on the right side of the operator's seat, and a throttle lever position sensor 34 is installed near the throttle lever 32 and outputs a signal in response to the position of the throttle lever 32 manipulated by the operator.

A shift lever 36 is mounted on the right side of the operator's seat near the throttle lever 32, and a shift lever position sensor 38 is installed near the shift lever 36 and outputs a signal in response to the position of the shift lever 36 manipulated (shifted) by the operator. Specifically, the sensor 38 outputs a signal indicative of corresponding one of a neutral position, a forward position and a reverse position selected by the operator.

A power tilt switch 40 for regulating the tilt angle and a power trim switch 42 for regulating the trim angle of the outboard motor 10 are also installed near the operator's seat. These switches output signals in response to tilt-up/down and trim-up/down instructions inputted by the operator. The outputs of the steering angle sensor 30, throttle lever position sensor 34, shift lever position sensor 38, power tilt switch 40 and power trim switch 42 are sent to the ECU 22 over signal lines 30L, 34L, 38L, 40L and 42L.

A rotation angle sensor 44 (shown in FIG. 2) is mounted at a position above the shift rod (explained later) and outputs a signal indicative of the rotation angle of the shift rod. The output of the rotation angle sensor 44 is sent to the ECU 22 over signal line 44L. Further, around the swivel case 12 and the stem bracket 14, there are installed a steering actuator, i.e., an electric motor (for steer) 46, and a conventional power tilt-trim unit 48 to regulate the tilt angle and trim angle of the outboard motor 10, that are connected to the ECU 22 through signal lines 46L and 48L. Inside the engine cover 20, there is installed an electric motor (for shift) 50 that is connected to the ECU 22 through the signal line 50L.

In response to the outputs of these sensors and switches, the ECU 22 operates the electric motor 46 (for steer) to steer the outboard motor 10, and operates the power tilt-trim unit 48 to regulate the tilt angle and trim angle of the outboard motor 10. It also operates the electric motor 50 (for shift) to conduct shift (i.e., to change the rotational direction of the propeller 24 or cut off the transmission of engine power to the propeller 24), and another electric motor (for opening/closing the throttle valve; not shown) to regulate the engine speed NE of the engine 18.

Figure 3:
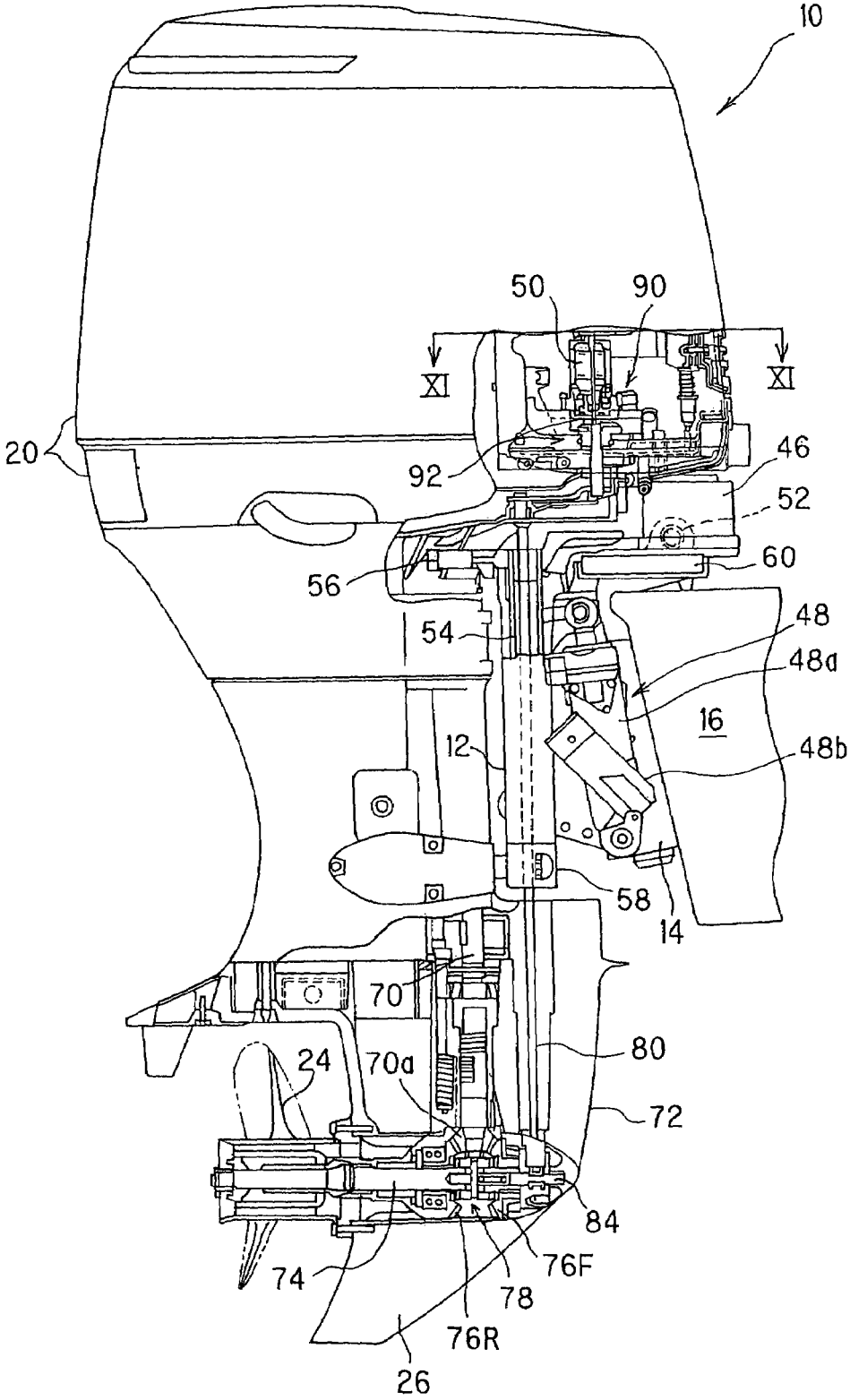
FIG. 3 is an enlarged explanatory side view of FIG. 2.

FIG. 3 is an enlarged partially-cutaway side view of FIG. 2.

As illustrated in FIG. 3, the power tilt-trim unit 48 is equipped with one hydraulic cylinder 48*a* for tilt angle regulation and, constituted integrally therewith, two hydraulic cylinders 48*b* for trim angle regulation (only one shown). One end (cylinder bottom) of the tilt hydraulic cylinder 48*a* is fastened to the stem bracket 14 and through it to the boat 16 and the other end (piston rod head) thereof abuts on the swivel case 12. One end (cylinder bottom) of each trim hydraulic cylinder 48*b* is fastened to the stem bracket 14 and through it to the boat 16, similarly to the one end of the tilt hydraulic cylinder 48*a*, and the other end (piston rod head) thereof abuts on the swivel case 12.

The swivel case 12 is connected to the stem bracket 14 through a tilting shaft 52 to be relatively displaceable about the tilting shaft 52. In other words, the swivel case 12 is connected to the boat 16 to be displaceable to each other about the tilting shaft 52. As mentioned above, the swivel shaft (now assigned with reference numeral 54) is rotatably accommodated inside the swivel case 12. The swivel shaft 54 extends in the vertical direction and has its upper end fastened to a mount frame 56 and its lower end fastened to a lower mount center housing (not shown). The mount frame 56 and lower mount center housing are fastened to a frame on which the engine 18 and the propeller 24, etc., are mounted.

The electric motor 46 (for steer) and a gearbox (gear mechanism) 60 for reducing the rotational speed of the electric motor 46 are fastened to an upper portion above the swivel case 12. The gearbox 60 is connected, at its input side, to the output shaft of the electric motor 46 and is connected, at its output side, to the mount frame 56. Horizontal steering of the outboard motor 10 is thus power-assisted using the rotational output of the electric motor 46 to swivel the mount frame 56 and thus turns the propeller 24 and rudder 26 about the vertical axis. The overall rudder turning angle (steerable angle) of the outboard motor 10 is 60 degrees, 30 degrees to the right and 30 degrees to the left.

The output of the engine 18 is transmitted, via the crankshaft (not shown) and a drive shaft 70, to a propeller shaft 74 accommodated in a gear case 72, and rotates the propeller 24 that is fixed to the propeller shaft 74. The rudder 26 is integrally formed with the gear case 72.

Figure 4:
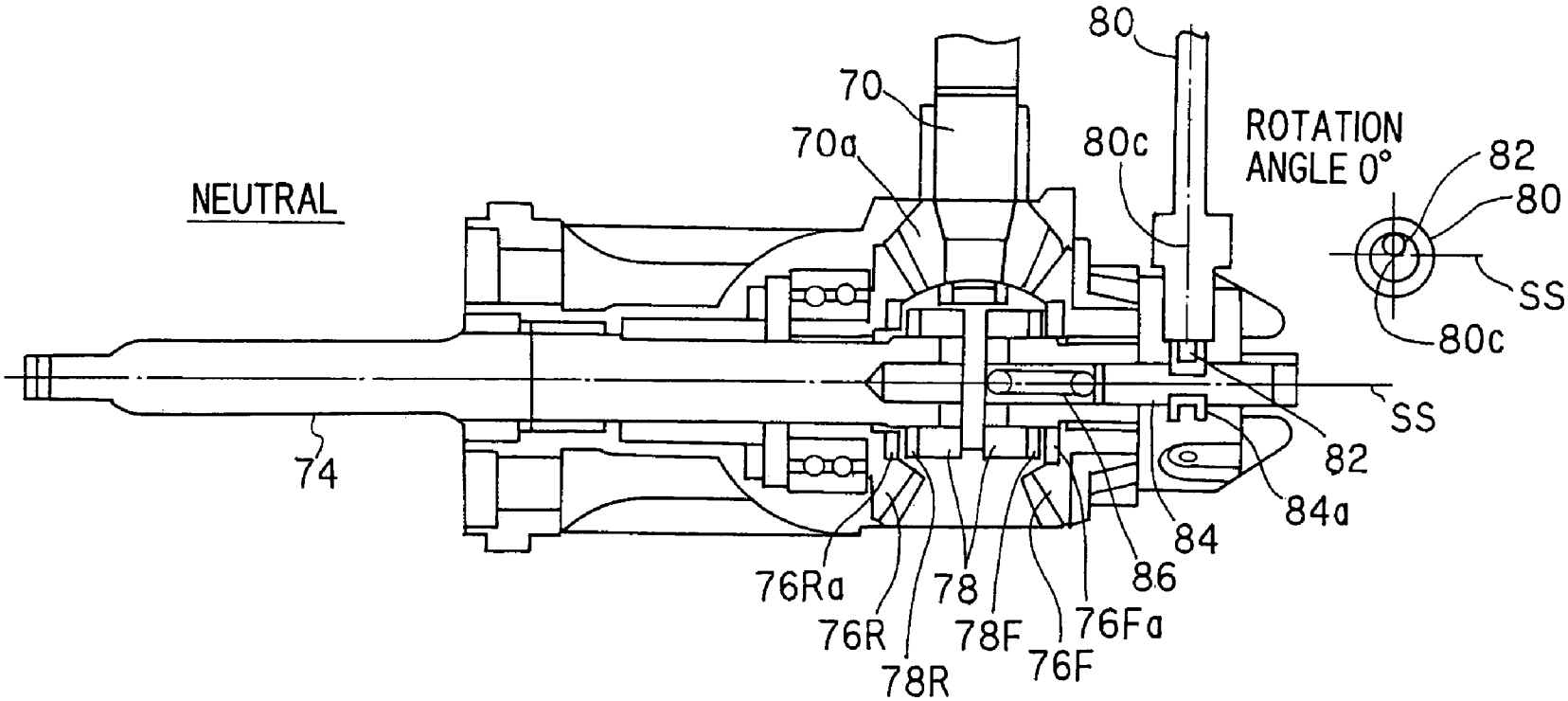
FIG. 4 is an enlarged sectional view of FIG. 3 and shows the positions of a shifter clutch and a rod pin when the shift position is neutral.

FIG. 4 is an enlarged sectional view of the propeller shaft 74 and thereabout. With reference to FIG. 4, the power transmission to the propeller shaft 74 will be explained in detail.

As shown in the figure, a forward gear 76F and a reverse gear 76R are provided around the propeller shaft 74, respective of which meshes with a drive gear 70*a* fixed to the bottom end of the drive shaft 70 and are rotated in opposite directions. The forward gear 76F and the reverse gear 76R are respectively formed with a plurality of projections 76Fa and 76Ra on their surfaces.

Figure 5:
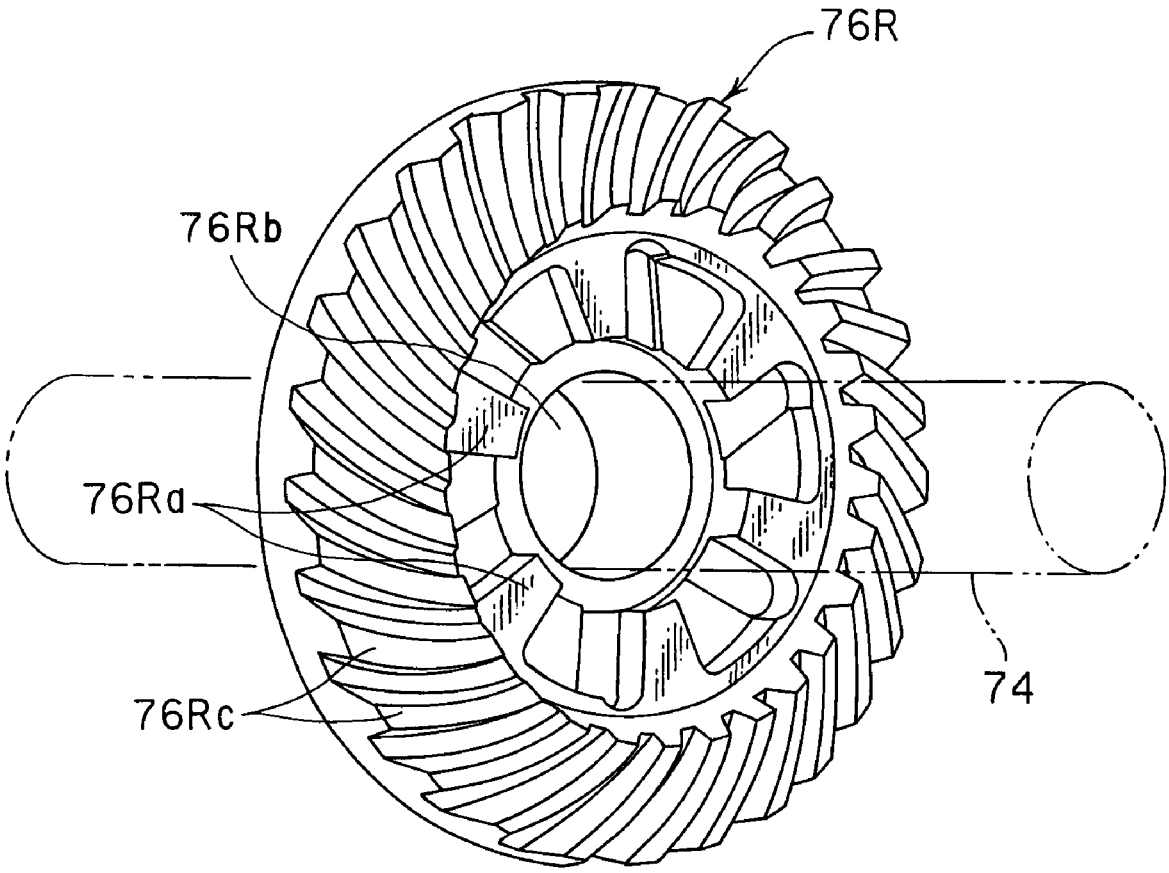
FIG. 5 is an enlarged perspective view of a reverse gear illustrated in FIG. 4.

FIG. 5 is an enlarged perspective view of the reverse gear 76R.

As shown in FIG. 5, the reverse gear 76R is formed with a hole 76Rb at its center in such a manner that the propeller shaft 74 can rotatably run therethrough. The plural projections 76Ra, more precisely six projections 76Ra are formed, with a uniform space or distance with each other, on a circular area provided between the hole 76Rb and teeth 76Rc. The heights of the six projections 76Ra are made equal. Although not shown, the forward gear 76F has a similar structure to that shown in FIG. 5. The forward gear 76F is also formed with a plurality of (six) projections 76Fa of same height that are spaced apart by a constant space or distance with each other on a circular area provided between a central hole and peripheral teeth.

Returning to the explanation of FIG. 4, a shifter clutch 78 is provided between the forward gear 76F and the reverse gear 76R to be rotated integrally with the propeller shaft 74. The shifter clutch 78 has a cylindrical shape whose axis is the same as the center axis of the propeller shaft 74. The shifter clutch 78 is formed, at a forward-gear-side end, with mated projections 78F to be meshed with the projections 76Fa of the forward gear 76 and is formed, at a reverse-gear-side end, with mated projections 78R to be meshed with the projections 76Ra of the reverse gear 76R. Thus, this meshed type of clutch (i.e., dog clutch) has the projections 76Fa and 76Ra formed on the forward gear 76F and the reverse gear 76R, and the mated projections 78F and 78R formed on the ends of the shifter clutch 78.

Figure 6:
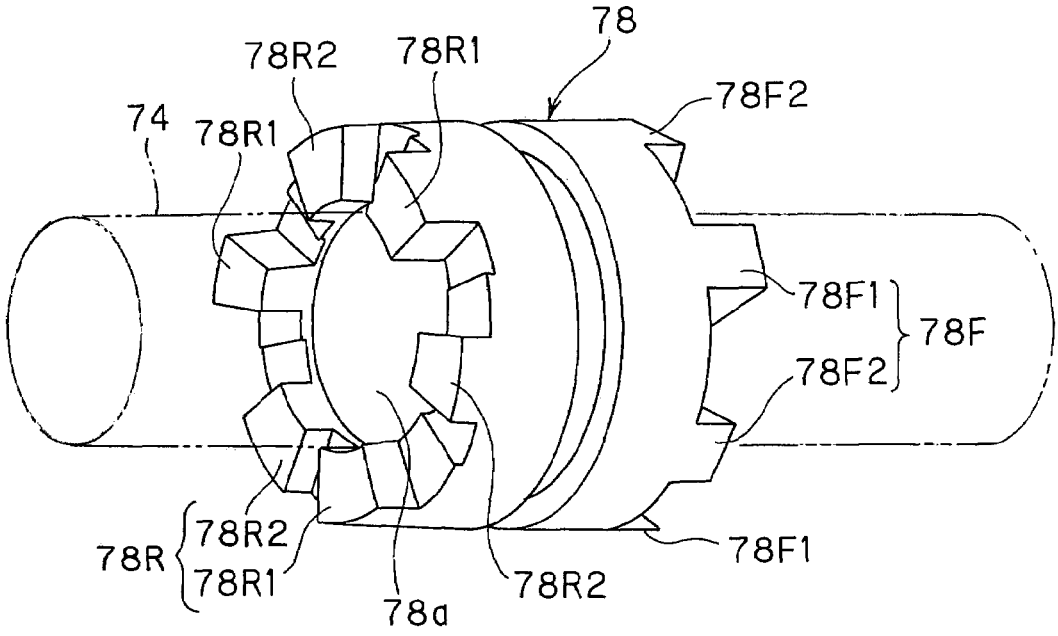
FIG. 6 is an enlarged perspective view of the shifter clutch illustrated in FIG. 4.
Figure 7:
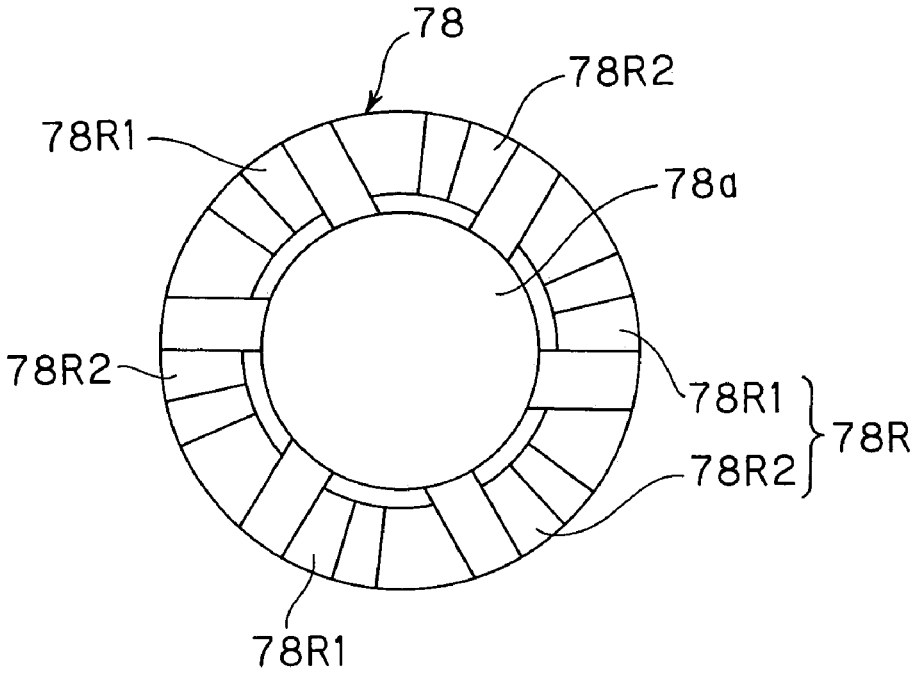
FIG. 7 is an enlarged plan view of the reverse-gear-side end of the shifter clutch illustrated in FIG. 4.
Figure 8:
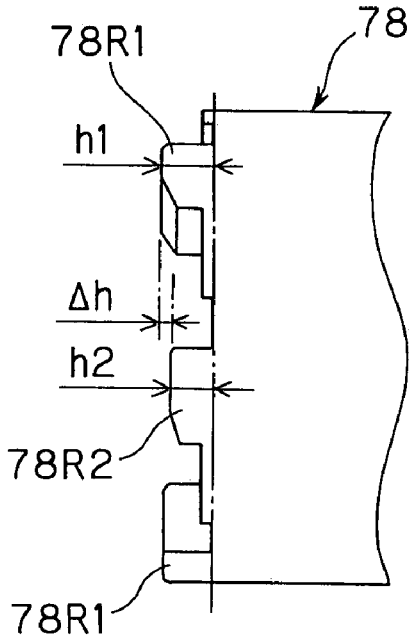
FIG. 8 is an enlarged side view of the reverse-gear-side end of the shifter clutch illustrated in FIG. 4.

FIG. 6 is an enlarged perspective view of the shifter clutch 78; FIG. 7 is an enlarged plan view of the reverse-gear-side end of the shifter clutch 78; and FIG. 8 is an enlarged side view of the reverse-gear-side end of the shifter clutch 78.

Explaining the shifter clutch 78 with reference to the figures, similarly to the forward/reverse gear 76, the reverse-gear-side end of the shifter clutch 78 is formed with a hole 78*a*. The propeller shaft 74 is passed through the hole 78*a* and fixed thereto. The plural projections 78R, more precisely six projections 78R are formed on a circular area around the hole 78*a*. The projections 78R are spaced apart with each other with a uniform distance. As shown in FIG. 8, the six projections 78R comprises a first group of three projections 78R1 each having a first height h1, and a second group of three projections 78R2 each having a second height h2 that is lower than the first height h1 by Δh. The first and second groups of the projections 78R1 and 78R2 are alternatively formed on the circular area.

As partly shown in FIG. 6, the forward-gear-side end of the shifter clutch 78 has a similar structure to that of the reverse-gear-side end. Specifically, the forward-gear-side end of the shifter clutch 78 is formed with a six projections 78F comprising a first group of three projections 78F1 each having the first height h1, and a second group of three projections 78F2 each having the second height h2 that is lower than the first height h1 by Δh. The first and second groups of the projections 78F1 and 78F2 are alternatively formed on a circular area around the hole.

Returning to the explanation with reference to FIG. 4, the gear case 72 rotatably accommodates the shift rod (now assigned with reference numeral 80). The shift rod 80 is formed with, at its end surface, a rod pin 82 at a position eccentric to the shaft center axis. The rod pin 82 is inserted into a cavity 84*a* formed on a shift slider 84 that is installed below the shift rod 80. The shift slider 84 is made slidable along a line extended from the propeller shaft 74 and the shifter clutch 78, and is connected to the shifter clutch 78 through a spring 86.

Figure 9:
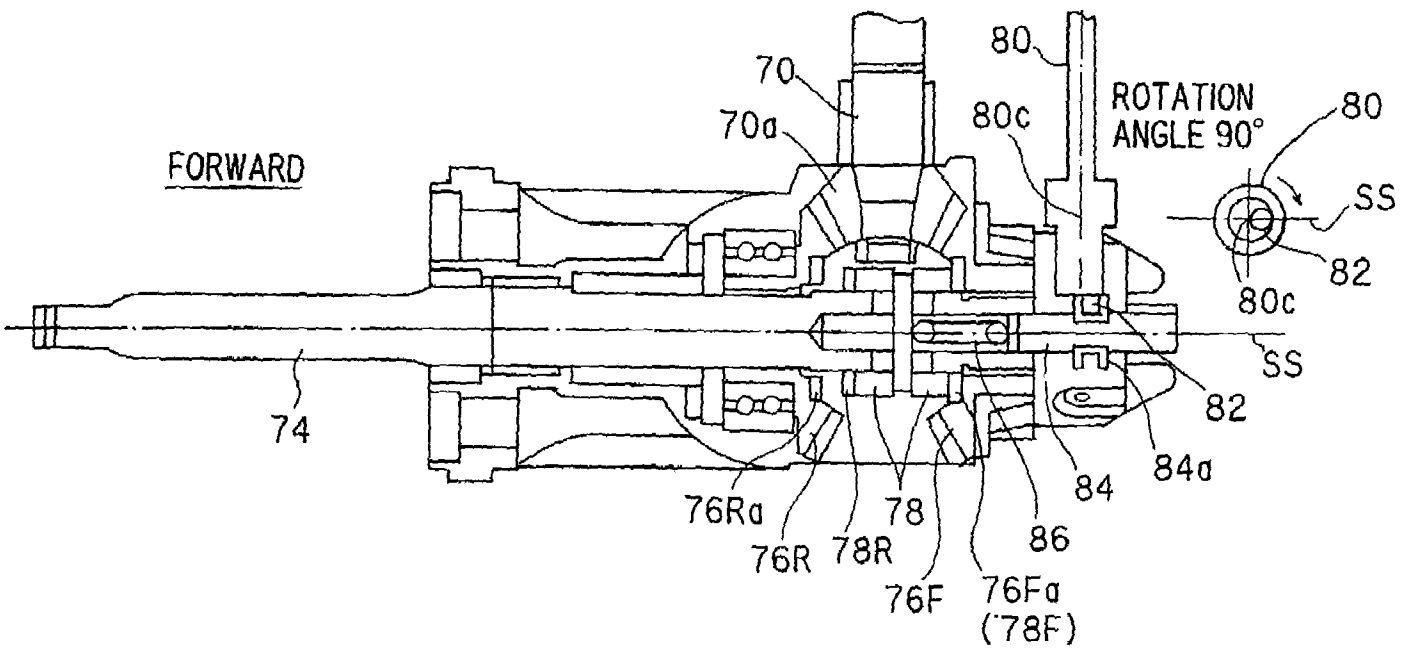
FIG. 9 is a view, similar to FIG. 4, but showing the positions of the shifter clutch and rod pin when the shift position is forward.
Figure 10:
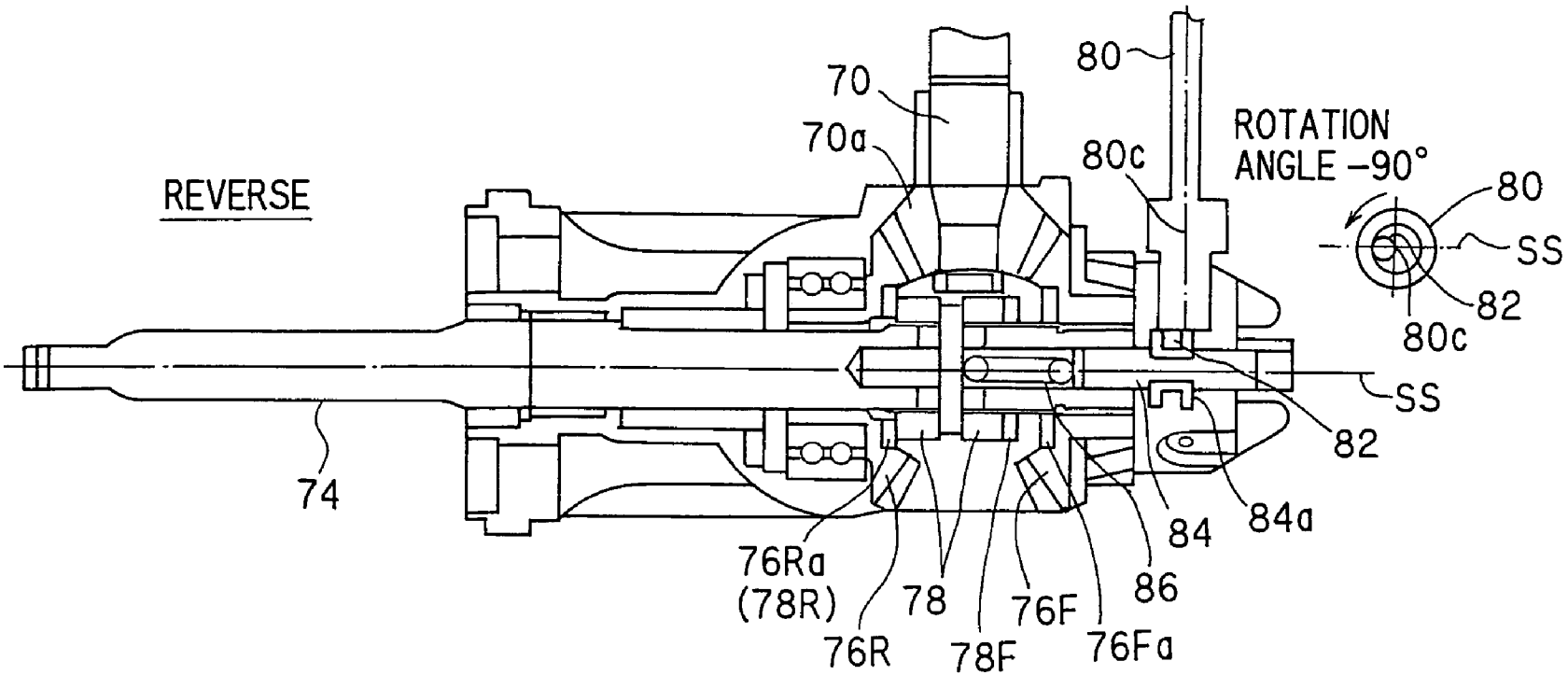
FIG. 10 is a view, similar to FIG. 4, but showing the positions of the shifter clutch and rod pin when the shift position is reverse.

FIG. 4 shows the positions of the shifter clutch 78 and the rod pin 82 when the shift position is neutral. FIG. 9 shows those when the shift position is forward, whilst FIG. 10 shows those when the shift position is reverse.

As illustrated in the figures, in response to a rotation of the shift rod 80, the rod pin 82 displaces along a locus of circular arc whose radius is corresponding to the amount of eccentricity from the center axis 80*c* of the shift rod 80. Specifically, in response to the rotation of the shift rod 80, the rod pin 82 displaces in a direction in which the shift slider 84 slides, i.e., in the direction of a line SS extended from center axis of the shift slider 84. With this, the shift slider 84 and the shifter clutch 78 slide by the action of the cavity 84*a*, and the shifter clutch 78 is brought into engagement with the forward gear 76F or the reverse gear 76R, or is held at the neutral position.

More specifically, as illustrated in FIG. 4, at the neutral position, a line connecting the shift rod's center axis 80*c* and the rod pin 82 intersects the line SS extended from the center axis of the shift slider 84, with a right angle. The angle of rotation of the shift rod 80 at this time is defined as zero. When the shift rod's angle of rotation is zero, neither of the projections 78F and 78R formed on the shifter clutch 78 are meshed with the projections 76Fa and 76Ra formed on the forward gear 76F and the reverse gear 76R. In other words, the shifter clutch 78 is not engaged with either of the forward gear 76F and the reverse gear 76R.

As illustrated in FIG. 9, when the shift rod 80 is rotated clockwise (in the figure) by 90 degrees from the neutral position, in other words, when the shift rod 80 is rotated such that the rod pin 82 is positioned on the line SS, the rod pin 82 displaces in the direction of the line SS by an amount corresponding to the amount of eccentricity. As a result, the shift slider 84 slides, through the cavity 84*a*, right (in the figure) in the direction of the forward gear 76F, and the projections 78F formed on the shifter clutch 78 is meshed with the projections 76Fa. Thus, the shifter clutch 78 is engaged with the forward gear 76F.

When the shifter clutch 78 begins to slide, in other words, at the time of the beginning of shift, the first group of projections 78F1 (of higher height in the projections 78F) mesh with the forward gear projections 76Fa such that the rotation of the shifter clutch 78 is brought into synchronism with that of the forward gear 76F. Then, as the shifter clutch 78 slides further, in addition to the first group of projections 78F1, the second group of projections 78F2 (of lesser height) mesh with the forward gear projections 76Fa, and the engagement of the shifter clutch 78 and the forward gear 76F is thus completed.

Next, the shift to reverse will be explained with reference to FIG. 10. As illustrated in the figure, when the shift rod 80 is rotated counterclockwise (in the figure) by 90 degrees from the neutral position such that the rod pin 82 is positioned on the line SS, the rod pin 82 displaces in the direction of the line SS by an amount corresponding to the amount of eccentricity, the shift slider 84 and the shifter clutch 78 slide, through the cavity 84*a*, left (in the figure) in the direction of the reverse gear 76R, and the projections 78R formed on the shifter clutch 78 is meshed with the projections 76Ra. Thus, the shifter clutch 78 is engaged with the reverse gear 76R.

Similarly to the shift to forward, when the shifter clutch 78 begins to slide, in other words, at the time of the beginning of shift, the first group of projections 78R1 (of higher height in the projections 78R) mesh with the reverse gear projections 76Ra such that the rotation of the shifter clutch 78 is brought into synchronism with that of the reverse gear 76R. Then, as the shifter clutch 78 slides further, in addition to the first group of projections 78R1, the second group of projections 78R2 (of lesser height) mesh with the reverse gear projections 76Ra, and the engagement of the shifter clutch 78 and the reverse gear 76R is thus completed.

Thus, in the shift mechanism according to the embodiment, at the time of the beginning of shift, the first group of projections 78F1 or 78R1 formed on the shifter clutch 78 mesh with the projections 76Fa or 76Ra formed on the forward gear 76F or the reverse gear 76R in such a manner that the rotation of the shifter clutch 78 is brought into synchronism with that of the forward gear 76F or the reverse gear 76R, and then, in addition to the first group of projections 78F1 or 78R1, the second group of projections 78F2 or 78R2 mesh with the forward gear projection 76Fa or the reverse gear projections 76Ra to complete the engagement of the shifter clutch 78 with the forward gear 76F or the reverse gear 76R. As a result, the engagement to the forward gear 76F or the reverse gear 76R can be completed smoothly, thereby enabling to mitigate shock during shift. Thus, these projections 76Fa, 76Ra and 78F (78F1, 78F2), 78R (78R1, 78R2) act as a shock mitigator that mitigates shock generated during shift.

Further, since the first group of projections 78F1 and 78R1 and the second group of projections 78F2 and 78R2 are respectively arranged in an alternative manner or in an every other manner with uniform distances therebetween, it becomes possible to exert uniform force or stress on each of the first group of the projections 78F1 and 78R1 at the beginning of shift, and then on each of the first and second groups of the projections 78F1, 78R1, 78F2 and 78R2 as the shift progresses. This can further mitigate shock during shift.

Moreover, the angle of rotation (more precisely, the angular range of rotation) of the shift rod 80 (necessary for the shifter clutch 78 to be engaged with the forward and reverse gear 76) is set to be approximately plus/minus 90 degrees, when the position of the rod pin 82 at the neutral (shown by phantom line) is defined as 0 degree. In other words, the angle of rotation of the shift rod 80 is set to be a range of 180 degrees beginning from the line SS extended from the center axis of the shift slider 84 and ending at the same line SS, such that the shift slider 84, the rod pin 82 and the center axis 80*c* of the shift rod 80 are aligned at the same straight line, at the beginning of shift. With this, the reaction force from the shift slider 84 to return to the neutral position does not act on the shift rod 80 as the torque to rotate it. Accordingly, in order to ensure this initial state, it is no longer necessary to add a retainer that retains the rotation of the shift rod 80. This makes the structure simple and can prevent the increase in number and weight of the components.

Returning to the explanation with reference to FIG. 3, the shift rod 80 extends vertically and penetrates the gear case 72 and the swivel case 12 (more precisely, the interior space of the swivel shaft 54 housed there), and finally reaches the inside of the engine cover 20 at its top end. At a position above the top end of the shift rod 80, the mount frame 56 is installed, in which there is installed a case 90 that accommodates the electric motor (for shift) 50, a reduction-gear mechanism and a sensory device (explained later) integrally as a unit.

Figure 11:
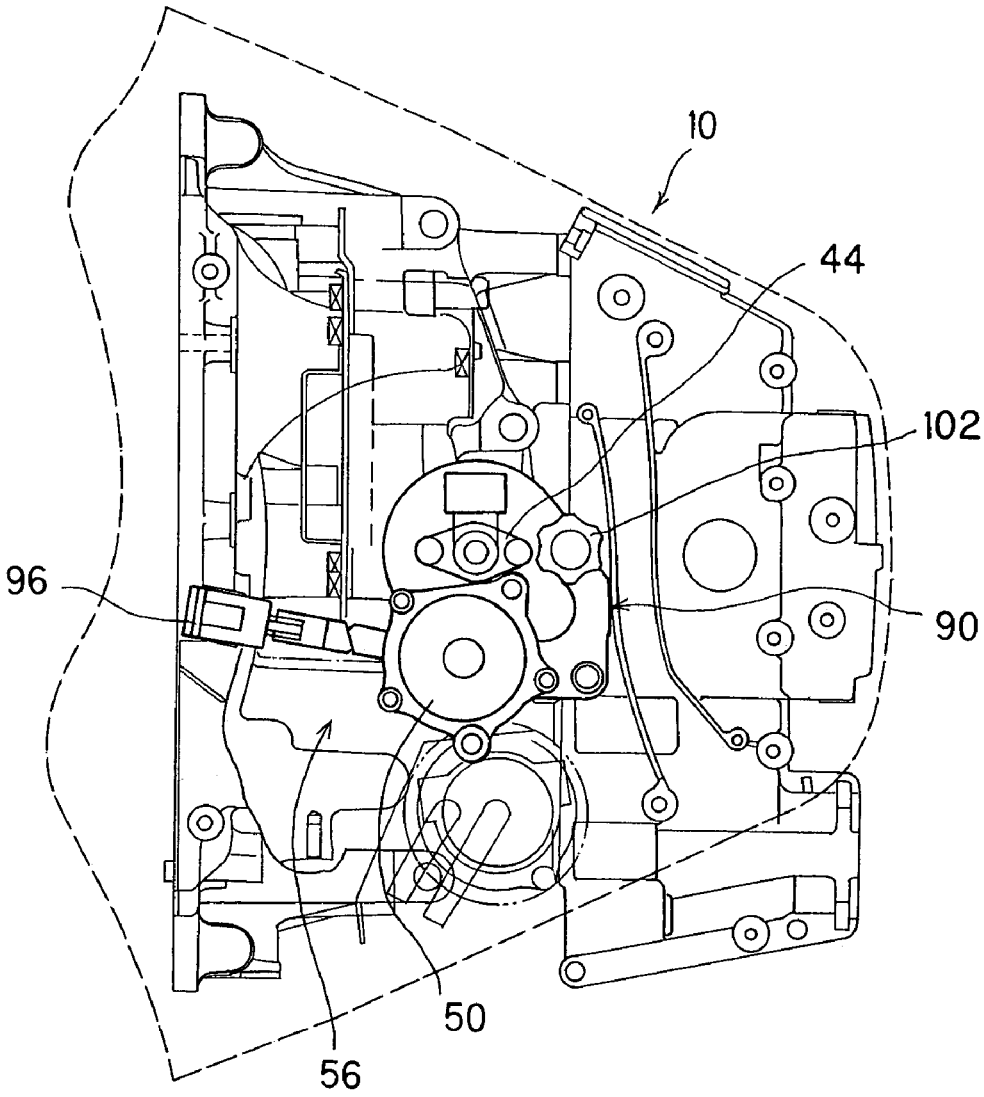
FIG. 11 is a cross-sectional view taken along the line XI—XI of FIG. 3.
Figure 12:
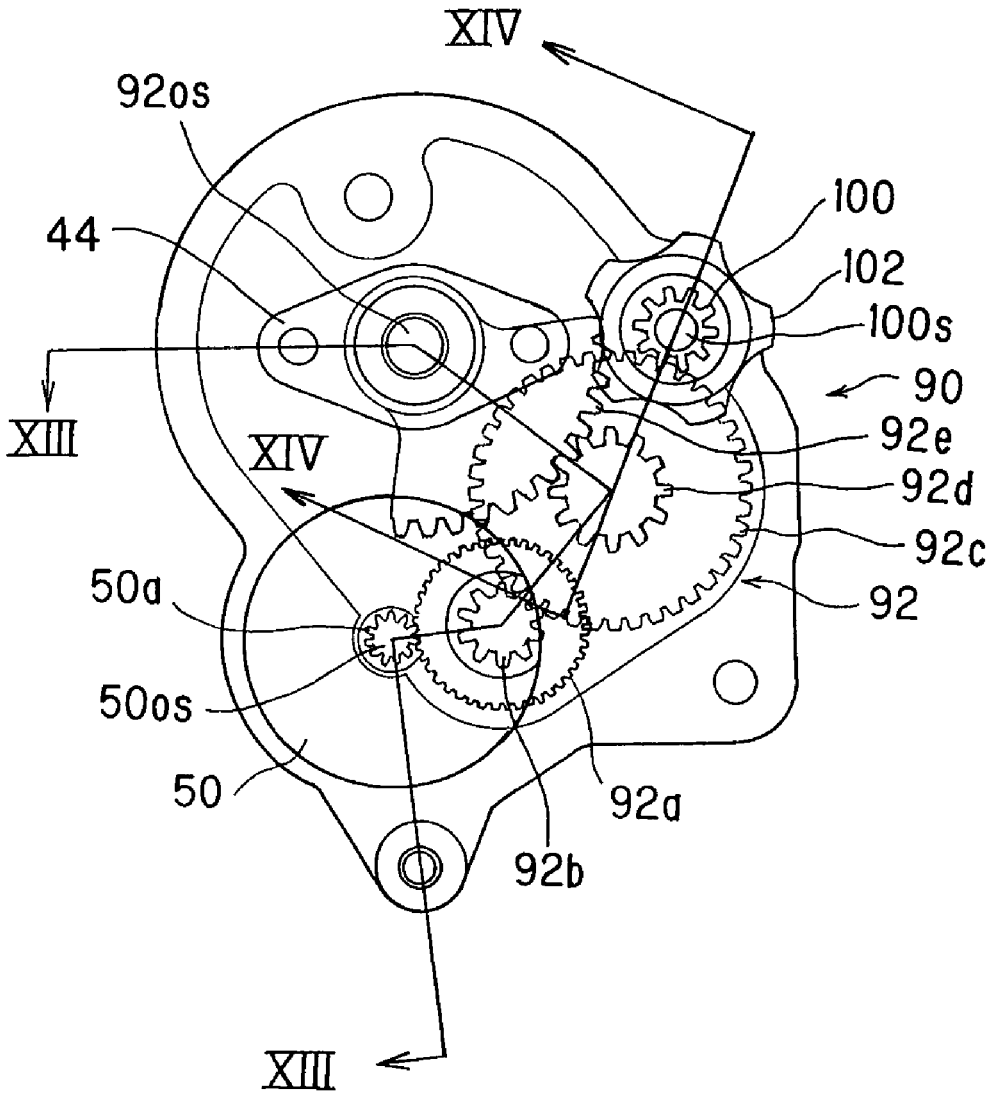
FIG. 12 is an enlarged (partially skeleton) explanatory view showing a case illustrated in FIG. 11.

FIG. 11 is a cross-sectional view taken along the line XI—XI of FIG. 3; FIG. 12 is an enlarged (partially skeleton) explanatory view showing the case 90 illustrated in FIG. 11; and FIG. 13 is a cross-sectional view taken along XIII—XIII of FIG. 12.

As shown in FIG. 3 and FIGS. 11 to 13, the case 90 accommodates, integrally as a unit, the electric motor 50 (for shift), a reduction-gear mechanism 92 that is connected to the electric motor 50 to reduce the rotational speed of the motor 50 and the rotation angle sensor 44 that is connected to an output shaft 92*os* of the reduction-gear mechanism 92 to generates a signal indicative of the angle of rotation of the output shaft 92*os* (i.e., the shift rod 80). The case 90 is detachably fastened, inside the engine cover 20, to the mount frame 56 by bolts. The electric motor 50 (for shift) is connected to the ECU 22 through harness 96 (shown in FIGS. 11 and 13).

Figure 13:
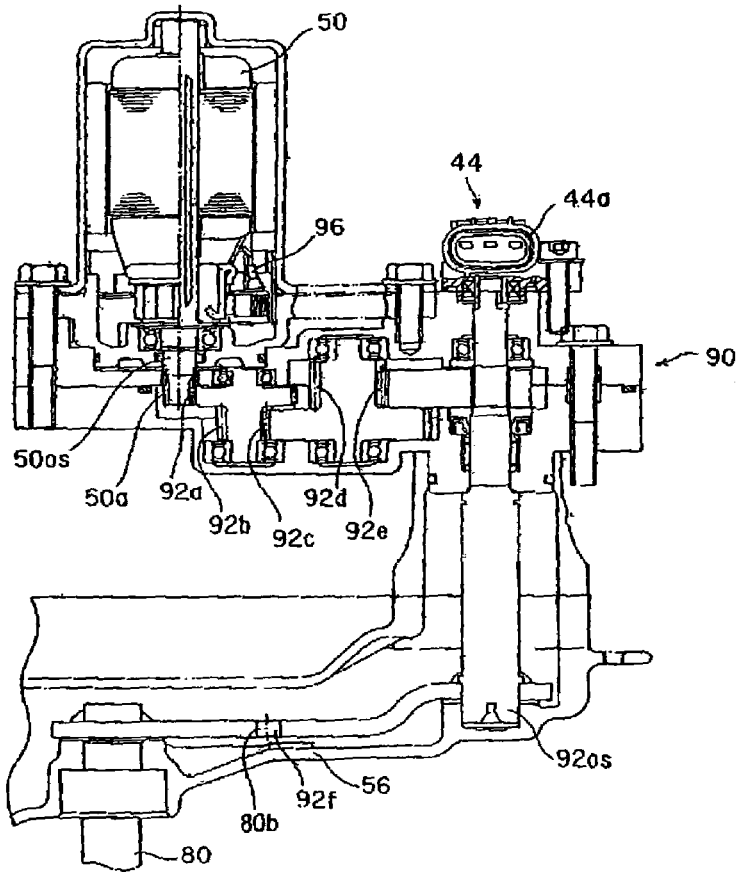
FIG. 13 is a cross-sectional view taken along XIII—XIII of FIG. 12.

As is best shown in FIGS. 12 and 13, the output shaft 50*os* of the electric motor 50 has an outputs shaft gear 50*a* that meshes with a first gear 92*a* of a larger diameter (having more teeth) than the output shaft gear 50*a*. A second gear 92*b* of a fewer diameter (having fewer teeth) than the first gear 92*a* is fastened to the first gear 92*a* coaxially therewith, and meshes with a third gear 92*c* of a larger diameter. A fourth gear 92*d* of a fewer diameter than the third gear 92*c* is fastened to the third gear 92*c* coaxially therewith. A fifth gear 92*e* of a larger diameter than the fourth gear 92*d* is fastened to the output shaft 92*os* of the reduction-gear mechanism 92 coaxially therewith, and meshes with the fourth gear 92*d*.

As is shown in FIG. 13, an output shaft gear 92*f* is fastened to the lower end of the output shaft 92*os* of the reduction-gear mechanism 92, and meshes with a shift-rod gear 80*b* fastened to the upper end of the shift rod 80. With this, the output of the electric motor 50 is reduced in speed, but is increased in torque, and is transmitted to the shift rod 80. Thus, the shift is power-assisted by operating the electric motor 50 to rotate the shift rod 80 about its center axis. This can mitigate the load than that under manual operation and offer improved operation feel.

The aforesaid rotation angle sensor 44 is installed at a position immediately above the reduction-gear mechanism 92, more precisely above the output shaft 92*os* of the reduction-gear mechanism 92. The rotation angle sensor 44 is connected to the ECU 22 via a connector 44*a* and harness (not shown) and sends the signal indicative of the angle of rotation of the output shaft 92*os*, i.e., the angle of rotation of the shift rod 80 to the ECU 22.

The ECU 22 detects the position (including one among the neutral, forward and reverse) of the shift lever 36 manipulated by the operator, and controls the operation of the electric motor 50 in response to the detected position of the shift lever 36 to effect the shift as instructed. At the same time, the ECU 22 feedback-controls the operation of the electric motor 50 using the output of the rotation angle sensor 44 indicative of the angle of rotation of the shift rod 80.

Specifically, when the shift lever 36 is detected to be at the neutral position, the ECU 22 determines a desired angle of rotation of the shift rod 80 to the aforesaid 0 degree, and controls the operation of the electric motor 50 such that an error between the desired value and the detected value (detected angle of shift rod rotation) decreases to zero. When the shift lever 36 is detected to be at the forward position, it determines the desired value to 90 degrees and controls the motor operation such that the error from the detected value decreases to zero, whereas it determines the desired value to—90 degrees and controls the motor operation in the same manner when the shift lever 36 is detected to be at the reverse position.

Thus, the ECU 22 feedback-controls the operation of the electric motor 50 based on the outputs of the shift lever position sensor 38 and the rotation angle sensor 44, such that the rotation angle of the shift rod 80 becomes equal to the desired angle of rotation that allows the shifter clutch 78 engages the forward gear 76F or the reverse gear 76R, thereby enabling to conduct shift surely.

Returning to the explanation of the reduction-gear mechanism 92, as illustrated in FIG. 12, the reduction-gear mechanism 92 is provided with an emergency gear 100.

Figure 14:
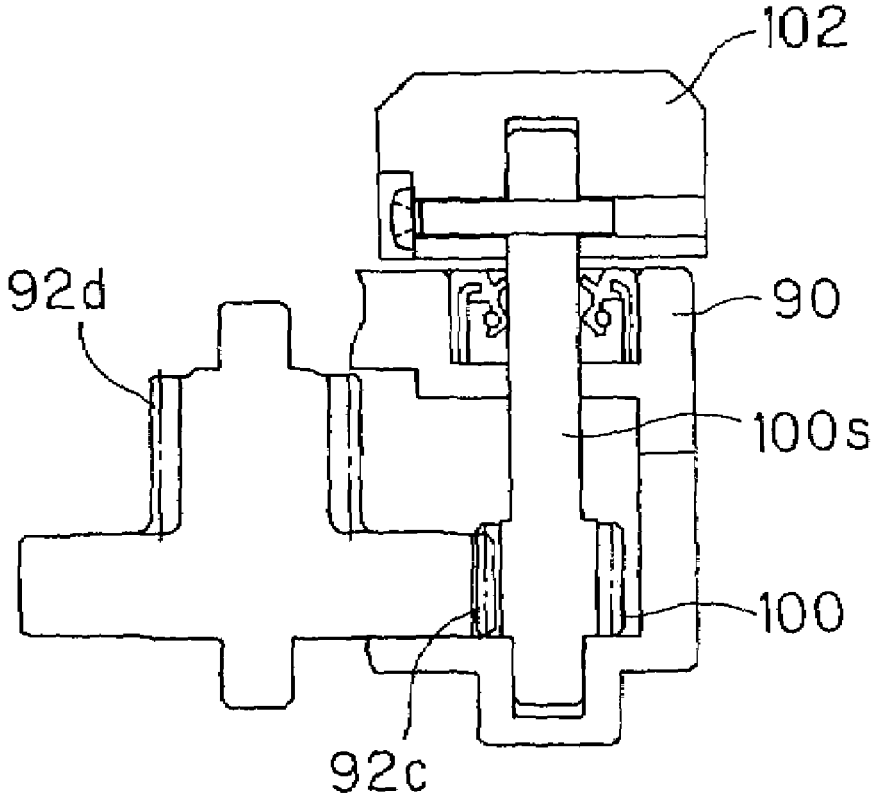
FIG. 14 is an enlarged cross-sectional view taken along the line of XIV—XIV of FIG. 12.

FIG. 14 is an enlarged cross-sectional view taken along the line of XIV—XIV of FIG. 12. As shown in FIGS. 12 and 14, the emergency gear 100 meshes with the third gear 92*c* in the reduction-gear mechanism 92. As shown in FIGS. 11, 12 and 14, the emergency gear 100 has a shaft 100*s* that penetrates the case 90 at its top to extend inside the engine cover 20 (not shown in the figures). A manually-operable grip 102 is fastened to the shaft 100*s* at the top. The grip 102 is formed to be a hexagonal shape (in plan view). With this, in case of failure of the electric motor 50, the operator can manually turn the grip 102 using a tool such as wrench to rotate the third gear 92*c*, after removing the engine cover 20, so as to rotate the shift rod 80 to change gear (shifting).

Figure 15:
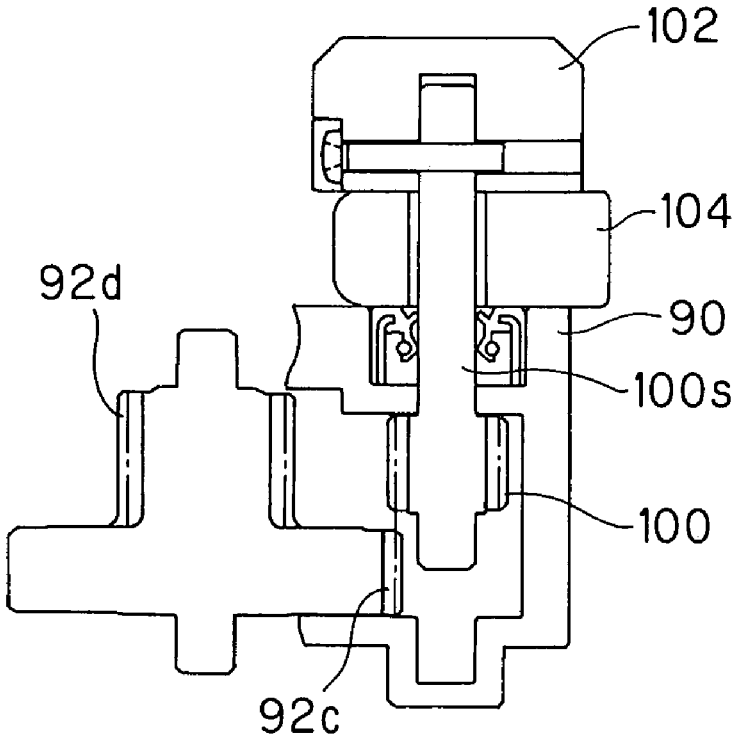
FIG. 15 is also an enlarged cross-sectional view taken along the line of XIV—XIV of FIG. 12.

As shown in FIG. 15, the emergency gear 100 is made slidable in the direction of vertical axis. Specifically, the operator can pinch the grip 102 and pull it up to insert a spacer 104 (made of plastic material) between the case 90 and the grip 102. With this, the emergency gear 100 is lifted upwardly to rest at a position where the engagement with the third gear 92*c* is relieved. More specifically, the emergency gear 100 is normally kept lifted by the spacer 104 and if manual gear change (shifting) is needed, the operator removes the spacer 104 to engage the emergency gear 100 with the third gear 92*c* so as to conduct shifting manually.

Figure 16:
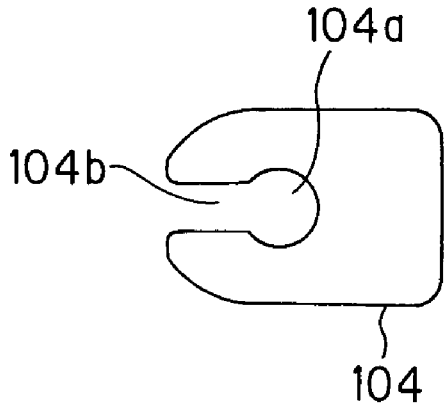
FIG. 16 is a plan view of a spacer illustrated in FIG. 15.

FIG. 16 is a plan view of the spacer 104. As shown in the figure, the spacer 104 has substantially a rectangular shape in plan view and is formed with an opening or hole 104*a* whose inner diameter is made slightly larger than the diameter of the shaft 100*s* of the emergency gear 100. A slit 104*b* is cut at a side of the spacer 104 to be continuous to the opening 104*a*. The width of the slit 104*b* is made slightly smaller than the diameter of the shaft 100*s* of the emergency gear 100. Since the spacer 104 is made of a plastic material, the operator can easily remove it from or put it to the shaft 100*s* by hand. Thus, the reduction-gear mechanism 92 (that transmits the output of the electric motor 50 to the shift rod 80) is provided with the manually-operable emergency gear 100 in such a way that the engagement or disengagement of the emergency gear 100 and the third gear 92*c* in the reduction-gear mechanism 92 can be carried out manually to move the shift rod 80, without using the output of the electric motor 50, to effect shifting.

Next, the prevention of shock acting on the electric motor (actuator) 50 will be further discussed.

As stated above, when the rotation of the forward/reverse gear 76 and that shifter clutch 78 are not in synchronism with each other at the time of shifting, a shock may sometimes happen and this causes the drive train (including the drive shaft 70, propeller shaft 74) to have excessive stress. This problem becomes serious if the structure of connection between the shift rod 80 and electric motor 50 is simplified as is disclosed in this embodiment, since the shock may be transmitted to the electric motor 50 through the shift rod 80 immediately (i.e., without being attenuated), thereby causing the electric motor 50 to experience the shock and the outboard motor 10 to vibrate.

Figure 17:
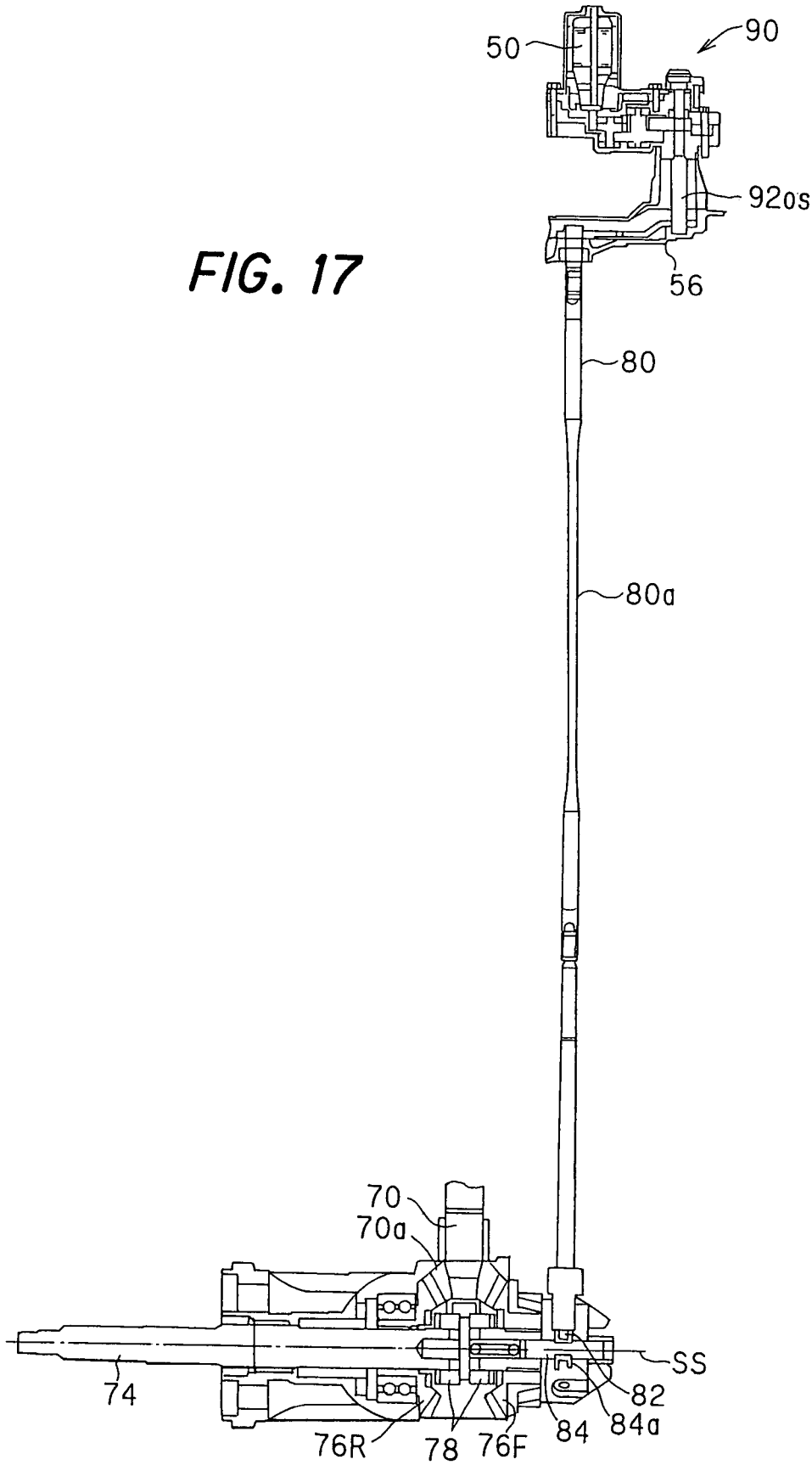
FIG. 17 is a side view of the shift rod illustrated in FIG. 3.

In view of the above, in the shift mechanism according to this embodiment, as shown in FIG. 17, the shift rod 80 is partially decreased its diameter to form a torsion portion 80*a*. More precisely, in the shift mechanism according to this embodiment, the shift rod 80 is a compact bar made of stainless steel and is 600 mm in length and 14 mm in diameter. And the shift rod 80 is decreased its diameter to 10 mm at a midway portion extending over 300 mm to provide the torsion portion 80*a*.

Since the torsion portion 80*a* thus formed is narrower than the rest, the stiffness against to torsion is less than that of the rest. With this, if stress (torsion) acts on the shift rod 80, its torsion portion 80*a* can easily be twisted to absorb the stress. Accordingly, if an excessive stress acts on the connection between the electric motor 50 and the shifter clutch 78, the stress can be absorbed or attenuated by torsion of the portion 80*a*, and hence, the stress to be transmitted from the electric motor 50 to the shifter clutch 78 and vice versa can be mitigated. Thus, the torsion portion 80*a* acts as the shock mitigator that mitigates shock generated during shift.

Here, the excessive stress indicates a stress or force greater than the output of the electric motor 50 (that drives the shifter clutch 78 to conduct shift), more precisely, the torque-increased output of the reduction-gear mechanism 92 connected to the electric motor 50. In the embodiment, the value is estimated to be 20 [N•m] and the torsion portion 80*a* should be designed taking this value into account.

Having been described in the above, in the outboard motor shift mechanism according to this embodiment, since the shift rod 80 is rotated by the electric motor 50 to power-assist the shifting of the outboard motor, the load to the operator is mitigated than that under manual operation and offer improved operation feel.

Further, since the electric motor 50, the reduction-gear mechanism 92, the rotation angle sensor 44 are integrally accommodated in the case 90 as a unit in such a manner that the case 90 is installed on the mount frame 56 positioned above the shift rod 80, this can decrease the distance between the shift rod 80 and the electric motor 50 (compared to a case that the electric motor 50 is installed at the boat 16), can make the structure simple and avoid increase in number of components and weight, while preventing a problem regarding space utilization.

Further, since the ECU 22 feedback-controls the operation of the electric motor 50 based on the outputs of the shift lever position sensor 38 and the rotation angle sensor 44 in such a way that the rotation angle of the shift rod 80 becomes equal to the desired angle of rotation that allows the shifter clutch 78 to engage the forward gear 76F or the reverse gear 76R, this can ensure shift, without fail.

Further, since the shift rod 80 is provided with the torsion portion 80*a,* if an excessive stress acts on the connection between the electric motor 50 and the shifter clutch 78, the stress can be absorbed or attenuated by torsion of the portion 80*a,* and hence, the stress to be transmitted from the electric motor 50 to the shifter clutch 78 and vice versa can be mitigated and attenuated.

Further, since the first group of projections 78F1 or 78R1 formed on the shifter clutch 78 mesh with the projections 76Fa or 76Ra formed on the forward gear 76R or the reverse gear 76R in such a manner that the rotation of the shifter clutch 78 is brought into synchronism with that of the forward gear 76F or the reverse gear 76R when the shifting is initiated, and then, in addition to the first group of projections 78F1 or 78R1, the second group of projections 78F2 or 78R2 mesh with the forward gear projections 76Fa or the reverse gear projections 76Ra to complete the engagement of the shifter clutch 78 with the forward gear 76F or the reverse gear 76R, the engagement to the forward gear 76F or the reverse gear 76R can be completed smoothly, while mitigating shock during shifting. This is significant in this embodiment, since the connection between the electric motor 50 and the shift rod 80 is simplified as frequently mentioned in the above.

Further, since the first group of projections 78F1 and 78R1 and the second group of projections 78F2 and 78R2 are respectively arranged in an alternative manner or in an every other manner with a uniform distance therebetween, it becomes possible to exert uniform force or stress on each of the first and second group of the projections 78F1, 78R1, 78F2 and 78R2 during the shifting, this can further mitigate shock during shift.

Further, since reduction-gear mechanism 92 is provided with the manually-operable emergency gear 100 such that the engagement or disengagement of the emergency gear 100 and the third gear 92*c* in the reduction-gear mechanism 92 can be carried out manually to move the shift rod 80 to shift, without using the output of the electric motor 50, it is convenient in case of failure of the electric motor 50.

Figure 18:
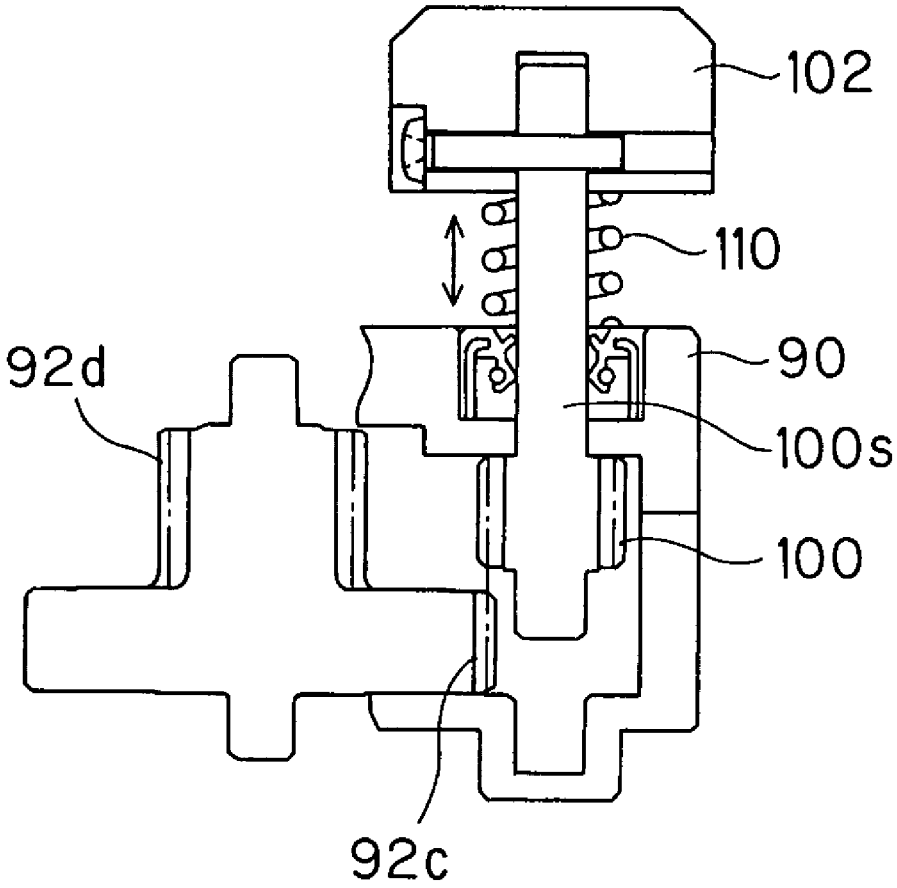
FIG. 18 is a view, similar to FIG. 15, but showing a shift mechanism for outboard motors according to a second embodiment of the invention.

FIG. 18 is a view, similar to FIG. 15, but showing a shift mechanism for outboard motors according to a second embodiment of the invention.

In the shift mechanism according to the second embodiment, instead of the spacer 104, a spring, more precisely a coil spring 110 is inserted between the case 90 and the manually-operable grip 102. The spring 110 urges the emergency gear 100 to be lifted upwards such that the engagement with the third gear 92*c* in the reduction-gear mechanism 92 is disconnected. When the shifting should be carried out manually, it suffices if the operator pushes the grip 102 down to connect the emergency gear 100 to the third gear 92*c*.

The rest of the second embodiment as well as the advantages and effects is the same as that of the first embodiment.

As mentioned above, the first to second embodiments are configured to provide a shift mechanism for an outboard motor 10 mounted on a stern of a boat 16 and having an internal combustion engine 18 at its upper portion and a propeller 24 at its lower portion that is powered by the engine to propel the boat, comprising: an actuator (electric motor 50) installed in the outboard motor; a shift rod 80 installed in the outboard motor and connected to the actuator to be rotatable by the actuator; a shifter clutch 78 installed in the outboard motor and connected to the shift rod, the shifter clutch being movable by the shift rod from a neutral position to engage with at least one of a forward gear 76F that allows the boat to be propelled in a forward direction and a reverse gear 76R that allows the boat to be propelled in a reverse direction opposite to the forward direction; a controller (ECU 22) controlling the actuator to rotate the shift rod such that the shifter clutch moves from the neutral position to engage with one of the forward gear and the reverse gear, corresponding to an inputted shift instruction made by the operator, to effect shift; and a shock mitigator (projections 76Fa, 76Ra, 78F1, 78F2, 78R1, 78R2 and torsion portion 80*a*) mitigating shock generated during the shift.

In the shift mechanism, specifically, the shock mitigator comprising: a plurality of gear projections 76Fa, 76Ra each formed at a portion of the forward gear 76F and the reverse gear 76R; and a first group of clutch projections 78F1, 78R1 formed on each end of the shifter clutch and having a first height h1 and a second group of clutch projections 78F2, 78R2 formed on each end of the shifter clutch having a second height h2 lesser than the first height, such that the first group of clutch projections first mesh with the gear projections so as to bring clutch rotation in synchronism with gear rotation, and then the second group of clutch projections additionally mesh with the gear projections. The first group of clutch projections is formed on each end of the shifter clutch 78 with a uniform space therebetween, whilst the second group of projections is formed on each end of the shifter clutch 78 with a uniform space therebetween. The first group of clutch projections and the second group of clutch projections are formed on each end of the shifter clutch alternatively.

In the shift mechanism, the shock mitigator comprising: a torsion portion 80*a* of the shift rod 80 whose diameter is decreased to be flexible by twisting about its axis when stress is exerted.

The shift mechanism further includes: a reduction-gear mechanism 92 connected to the actuator (electric motor 50) to reduce a rotation of the actuator and transmit it to the shift rod; and a case 90 accommodating the actuator and the reduction-gear mechanism as a unit at a position immediately above the shift rod.

The shift mechanism further includes: a rotational angle sensor 44 generating a signal indicative of an angle of rotation of the shift rod; and a shift lever position sensor 38 generating a signal indicative of a position of a shift lever selected by the operator from among neutral, forward and reverse positions; and the controller inputs signals of the rotational angle sensor and the shift lever position sensor and controls the actuator in such a manner that the detected angle of rotation of the shift rod becomes a desired angle of rotation necessary for the shifter clutch to move from the neutral position to engage with one of the forward gear and the reverse gear determined from the detected position of the shift lever to effect the shift. The rotation angle sensor 44 is accommodated in the case 90 together with the actuator and the reduction-gear mechanism. The mechanism further includes: a reduction-gear mechanism 92 connected to the actuator to reduce a rotation of the actuator and transmit it to the shift rod; and an emergency gear 100 manually connectable to the reduction-gear mechanism to rotate the shift rod to effect shift. The emergency gear 100 is connected to a manually-operable grip 102 that allows the emergency gear manually connected to the reduction-gear mechanism to rotate the shift rod 80 to effect shift.

As mentioned above, the first to second embodiments are configured to provide a shift mechanism for an outboard motor 10 mounted on a stem of a boat 16 and having an internal combustion engine 18 at its upper portion and a propeller 24 at its lower portion that is powered by the engine to propel the boat, comprising: an electric motor 50 installed in the outboard motor; a reduction-gear mechanism 92 connected to the electric motor to reduce a rotation of the electric motor; a shift rod 80 installed in the outboard motor and connected to the reduction-gear mechanism to be rotatable by a reduced rotation of the reduction-gear mechanism; a shifter clutch 78 installed in the outboard motor and connected to the shift rod, the shifter clutch being movable by the shift rod from a neutral position to engage with at least one of a forward gear 76F that allows the boat to be propelled in a forward direction and a reverse gear 76R that allows the boat to be propelled in a reverse direction opposite to the forward direction; and a case 90 accommodating the electric motor and the reduction-gear mechanism as a unit at a position immediately above the shift rod.

The shift mechanism further includes: a rotational angle sensor 44 generating a signal indicative of an angle of rotation of the shift rod; a shift lever position sensor 38 generating a signal indicative of a position of a shift lever 36 selected by the operator from among neutral, forward and reverse positions; and a controller (ECU 22) inputting signals of the rotational angle sensor and the shift lever position sensor and controlling the electric motor in such a manner that the detected angle of rotation of the shift rod 80 becomes a desired angle of rotation necessary for the shifter clutch 78 to engage with one of the forward gear and the reverse gear determined from the detected position of the shift lever to effect shift. The rotation angle sensor is accommodated in the case together with the electric motor and the reduction-gear mechanism.

As mentioned above, the first to second embodiments are configured to provide a shift mechanism for an outboard motor 10 mounted on a stem of a boat 16 and having an internal combustion engine 18 at its upper portion and a propeller 24 at its lower portion that is powered by the engine to propel the boat, comprising: an actuator (electric motor 50) installed in the outboard motor; a reduction-gear mechanism 92 connected to the actuator to reduce a rotation of the actuator; a shift rod 80 installed in the outboard motor and connected to the reduction-gear mechanism to be rotatable by a reduced rotation of the reduction-gear mechanism; a shifter clutch 78 installed in the outboard motor and connected to the shift rod, the shifter clutch 78 being movable by the shift rod 80 from a neutral position to engage with at least one of a forward gear 76F that allows the boat to be propelled in a forward direction and a reverse gear 76R that allows the boat to be propelled in a reverse direction opposite to the forward direction; and an emergency gear 100 manually connectable to the reduction-gear mechanism to rotate the shift rod to effect shift.

The emergency gear is connected to a manually-operable grip 102 that allows the emergency gear manually connected to the reduction-gear mechanism 92 to rotate the shift rod 80 to effect shift.

It should be noted in the above, although the electric motor (for shift) 50 is used as the actuator, it is alternatively possible to use other actuators such as a hydraulic cylinder.

It should also be noted that, although the size or material of the shift rod 80 and its torsion portion 80*a* are described specifically, the description is an example, and the invention should not be limited thereto.

The entire disclosure of Japanese Patent Application Nos. 2003-010048 filed on Jan. 17, 2003 and Nos. 2003-036740 to 2003-036742 all filed on Feb. 14, 2003 including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A shift mechanism for an outboard motor mounted on a stern of a boat and having an internal combustion engine at its upper portion and a propeller at its lower portion that is powered by the engine to propel the boat, comprising:

an actuator installed in the outboard motor;

a shift rod installed in the outboard motor and connected to the actuator to be rotatable by the actuator;

a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to the propelled in a reverse direction opposite to the forward direction;

a controller controlling the actuator to rotate the shift rod such that the shifter clutch moves from the neutral position to engage with one of the forward gear and the reverse gear, corresponding to an inputted shift instruction made by an operator, to effect shift; and a shock mitigator mitigating shock generated during the shift, wherein the shock mitigator comprises:

a torsion portion of the shift rod whose diameter is decreased to be flexible by twisting about its axis when stress is exerted, and further wherein the torsion portion is positioned so that the midpoint along the axis of the shift rod is located within the torsion portion.

2. A shift mechanism for an outboard motor mounted on a stern of a boat and having an internal combustion engine at its upper portion and a propeller at its lower portion that is powered by the engine to propel the boat, comprising;

an actuator installed in the outboard motor;

a shift rod installed in the outboard motor and connected to the actuator to be rotatable by the actuator;

a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to be propelled in a reverse direction opposite to the forward direction;

a controller controlling the actuator to rotate the shift rod such that the shifter clutch moves from the neutral position to engage with one of the forward gear and the reverse gear, corresponding to an inputted shift instruction made by an operator, to effect shift; and a shock mitigator mitigating shock generated during the shift, wherein the shift mechanism further includes:

a reduction-gear mechanism connected to the actuator to reduce a rotation of the actuator and transmit it to the shift rod; and a case accommodating the actuator and the reduction-gear mechanism as a unit at a position immediately above the shift rod.

3. A shift mechanism according to claim 2, further including:

a rotational angle sensor generating a signal indicative of an angle of rotation of the shift rod; and a shift lever position sensor generating a signal indicative of a position of a shift lever selected by the operator from among neutral, forward and reverse positions;

and the controller inputs signals of the rotational angle sensor and the shift lever position sensor and controls the actuator in such a manner that the detected angle of rotation of the shift rod becomes a desired angle of rotation necessary for the shifter clutch to move from the neutral position to engage with one of the forward gear and the reverse gear determined from the detected position of the shift lever to effect the shift.

4. A shift mechanism according to claim 3, wherein the rotation angle sensor is accommodated in the case together with the actuator and the reduction-gear mechanism.

5. A shift mechanism for an outboard motor mounted on a stern of a boat and having an internal combustion engine at its upper portion and a propeller at its lower portion that is powered by the engine to propel the boat, comprising:

an actuator installed in the outboard motor;

a shift rod installed in the outboard motor and connected to the actuator to be rotatable by the actuator;

a shifter clutch installed in the outboard motor and connected to the shift rod, the shifter clutch being movable by the shift rod from a neutral position to engage with at least one of a forward gear that allows the boat to be propelled in a forward direction and a reverse gear that allows the boat to be propelled in a reverse direction opposite to the forward direction;

a controller controlling the actuator to rotate the shift rod such that the shifter clutch moves from the neutral position to engage with one of the forward gear and the reverse gear, corresponding to an inputted shift instruction made by an operator, to effect shift; and a shock mitigator mitigating shock generated during the shift, wherein the shift mechanism further includes:

a reduction-gear mechanism connected to the actuator to reduce a rotation of the actuator and transmit it to the shift rod; and an emergency gear manually connectable to the reduction-gear mechanism to rotate the shift rod to effect shift.

6. A shift mechanism according to claim 5, wherein the emergency gear is connected to a manually-operable grip that allows the emergency gear manually connected to the reduction-gear mechanism to rotate the shift rod to effect shift.

* * * * *